US011105053B2

(12) United States Patent
Robbins

(10) Patent No.: US 11,105,053 B2
(45) **Date of Patent: *Aug. 31, 2021**

(54) WHEEL STOP

(71) Applicant: RubberForm Recycled Products, LLC, Lockport, NY (US)

(72) Inventor: William J. Robbins, Lockport, NY (US)

(73) Assignee: RUBBERFORM RECYCLED PRODUCTS, LLC, Lockport, NY (US)

( * ) Notice: Subject to any disclaimer, the term of this patent is extended or adjusted under 35 U.S.C. 154(b) by 18 days.

This patent is subject to a terminal disclaimer.

(21) Appl. No.: 16/512,935

(22) Filed: Jul. 16, 2019

(65) Prior Publication Data

US 2019/0338476 A1 Nov. 7, 2019

Related U.S. Application Data

(63) Continuation of application No. 15/890,065, filed on Feb. 6, 2018, now Pat. No. 10,370,806.

(51) Int. Cl.

| | |
|---|---|
| ***E01F 15/04*** | (2006.01) |
| ***E01F 15/08*** | (2006.01) |
| ***G09F 19/22*** | (2006.01) |
| ***E01F 9/541*** | (2016.01) |
| ***E01F 9/588*** | (2016.01) |

(52) U.S. Cl.

CPC ..... *E01F 9/541* (2016.02); *E01F 9/588* (2016.02); *E01F 15/0461* (2013.01); *E01F 15/086* (2013.01); *G09F 19/22* (2013.01)

(58) Field of Classification Search

CPC ..... E01F 9/541; E01F 9/692; E01F 15/0461; E01F 15/086; E01F 15/146; G09F 19/22

See application file for complete search history.

(56) References Cited

U.S. PATENT DOCUMENTS

| | | | | |
|---|---|---|---|---|
| 3,065,680 | A | 11/1962 | Wiedman, Sr. | |
| 4,762,438 | A | 8/1988 | Dewing | |
| 5,221,785 | A | 6/1993 | Ando et al. | |
| 5,428,914 | A * | 7/1995 | Whitehouse | G09F 7/06 40/594 |
| 5,639,179 | A | 6/1997 | Jensen | |
| D393,320 | S | 4/1998 | Sinclair | |
| 5,772,357 | A | 6/1998 | Evans | |

(Continued)

*Primary Examiner* — Abigail A Risic

(74) *Attorney, Agent, or Firm* — Hauptman Ham, LLP

(57) ABSTRACT

An apparatus includes a base having a length in a first direction, a height in a second direction different from the first direction, and a depth in a third direction different from the first direction and the second direction. The base includes at least one sidewall having an outer surface, an inner surface, and an edge defining an open end of a cavity within the base. The base also includes a plurality of ribs extending from the inner surface of the at least one sidewall toward the open end of the cavity. The ribs of the plurality of ribs are separated from one another along the first direction. The base further includes at least one tube extending from the inner surface of the at least one sidewall toward the open end of the cavity. The apparatus also includes at least one plaque removably attached to the outer surface of base.

20 Claims, 8 Drawing Sheets

(56) References Cited

U.S. PATENT DOCUMENTS

| | | | | |
|---|---|---|---|---|
| 5,836,714 | A * | 11/1998 | Christensen | E01F 13/022 404/6 |
| 5,862,616 | A * | 1/1999 | Peroni | G09F 3/20 40/607.15 |
| 6,481,921 | B1 | 11/2002 | Fenimore et al. | |
| 6,692,182 | B1 | 2/2004 | Fenimore et al. | |
| 7,249,910 | B2 | 7/2007 | Eckert et al. | |
| 7,351,003 | B1 | 4/2008 | Fenimore et al. | |
| 7,758,278 | B2 | 7/2010 | Tamburro | |
| D625,677 | S | 10/2010 | Robbins, Sr. et al. | |
| 7,997,823 | B2 | 8/2011 | Meyers | |
| 8,226,321 | B2 | 7/2012 | Meyers | |
| D665,455 | S | 8/2012 | Giudicelli | |
| 9,382,678 | B2 | 7/2016 | Rogers | |
| 9,725,856 | B2 | 8/2017 | Povoli | |
| 2002/0017046 | A1* | 2/2002 | Lavoie | G09F 15/0056 40/611.01 |
| 2007/0098490 | A1 | 5/2007 | Christensen | |
| 2009/0195002 | A1 | 8/2009 | Meyers | |
| 2011/0280656 | A1 | 11/2011 | Meyers | |

* cited by examiner

WHEEL STOP

CROSS-REFERENCE TO RELATED APPLICATION

This application is a continuation of U.S. patent application Ser. No. 15/890,065, filed Feb. 6, 2018, the disclosure of which is incorporated herein in its entirety.

BACKGROUND

Parking spaces often have curbs that restrict movement of a wheel. These curbs are sometimes referred to as wheel stops. Curbs or wheel stops are sometimes made out of concrete or some other material. Manufacturers are continually challenged to improve the service life of wheel stops.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
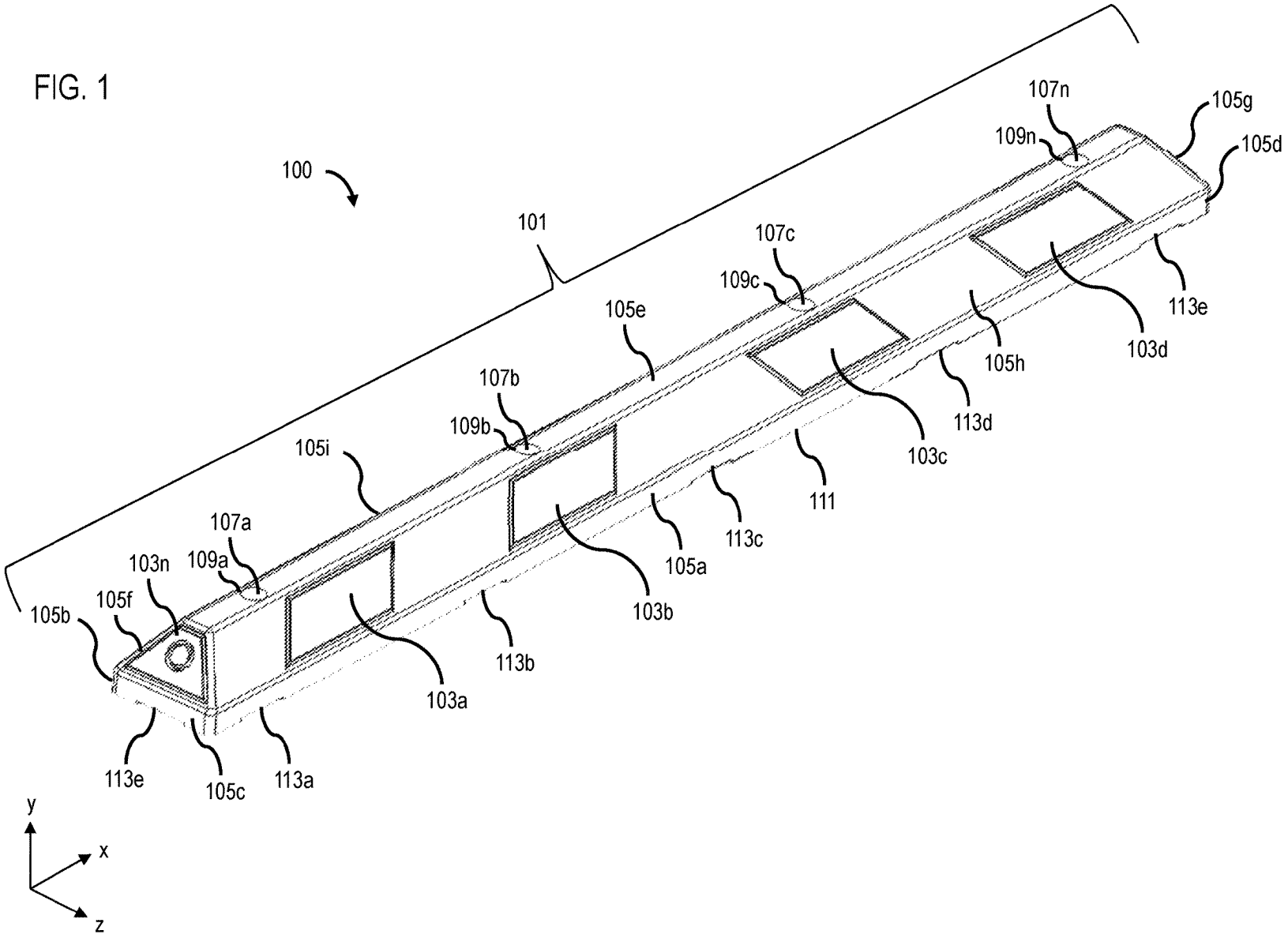
FIG. 1 is a right-side perspective view of a wheel stop, in accordance with one or more embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Wheel stops are often heavy, solid, objects that are positioned over a surface at an end of a parking space to restrict movement of a wheel. Some wheel stops contain steel rebar for reinforcement. Wheel stops are usable to delineate parking spaces and help to ensure vehicles stop at the proper location when parking—preventing damage to buildings, sidewalks, curbs, signage, posts, walls, and delicate landscaping. Some wheel stops rely on the weight of the wheel stop, for example, to keep the wheel stop in place upon being contacted by a vehicle tire or wheel. Some wheel stops accommodate one or more rods, lag bolts, shafts or other fasteners that are driven into the surface over which the wheel stop is positioned to keep the wheel stop securely in place.

Wheel stops sometimes have printed text, colored stripes, or reflective materials that are applied to a surface of the wheel stop. As time progresses, and the wheel stop is subjected to the surrounding environment, transport, collision with vehicle wheels, or other instances that cause wear and tear on the wheel stop surface, the wheel stop may crack, break, crumble or be otherwise marred. If, for example, a printed material, advertisement or reflective applied material is worn off the wheel stop, the wheel stop is often replaced. Replacing wheel stops is expensive for consumers and produces waste that could be harmful to the environment.

FIG. 1 is a right-side perspective view of a wheel stop 100, in accordance with one or more embodiments. Wheel stop 100 comprises a base 101 and plaques 103*a*-103*n* (collectively referred to as "plaque 103"). Plaques 103 are removably attached to one or more outer surfaces of base 101. Plaques 103 are configured to be readily replaceable, which makes it possible to increase the service life and functionality of wheel stop 100 compared to conventional wheel stops.

Base 101 has a length in the x-direction, a height in the y-direction, and a depth in the z-direction. The x-direction is substantially perpendicular to the y-direction, and the z-direction is substantially perpendicular to at least one of the x-direction or the y-direction. Base 101 comprises sidewalls 105*a*-105*i* (collectively referred to as "sidewall 105"). Sidewalls 105 have an outer surface, an inner surface, and an edge defining an open end of a cavity (see FIG. 2) within the base 101. In some embodiments, base 101 comprises a single sidewall 105. In some embodiments, multiple sidewalls 105 are integrally formed comprising a continuous material and one sidewall having a plurality of inner and outer surfaces. In some embodiments, base 101 comprises some other suitable quantity of sidewalls 105.

Sidewall 105*a* has length in the x-direction and a width in the y-direction. Sidewall 105*b* has a length in the x-direction and a width in the y-direction. Sidewall 105*b* is separated from the sidewall 105*a* by a distance in the z-direction. In some embodiments, sidewall 105*b* is separated from sidewall 105*a* by a distance that is less than the length of one or more of sidewall 105*a* or sidewall 105*b*.

Sidewall 105*c* extends from an end of sidewall 105*a* to an end of sidewall 105*b*. Sidewall 105*c* has a length in the z-direction and a width in the y-direction. Sidewall 105*d* extends from an end of the sidewall 105*a* that is opposite to sidewall 105*c* to an end of sidewall 105*b* that is opposite to sidewall 105*c*. Sidewall 105*d* has a length in the z-direction and a width in the y-direction.

Sidewall 105*e* has a length in the x-direction and a width in the z-direction. Sidewall 105*e* is separated from sidewall 105*a*, sidewall 105*b*, third sidewall 105*c* and sidewall 105*d* by a distance in the y-direction. The length of sidewall 105*e* is less than the length of sidewall 105*a* and less than the length of sidewall 105*b*. The width of sidewall 105*e* is less than the length of sidewall 105*c* and less than the length of sidewall 105*d*. In some embodiments, sidewall 105*e* is shorter in length than sidewall 105*a* or sidewall 105*b*. In some embodiments, sidewall 105*e* has length that is equal to the length of at least one of sidewall 105*a* or 105*b*.

Sidewall 105*f* extends from sidewall 105*c* to an end of sidewall 105*e*. Sidewall 105*g* extends from sidewall 105*d* to an end of sidewall 105*e* opposite sidewall 105*f*. Sidewall 105*h* extends from sidewall 105*a* to sidewall 105*e* and from sidewall 105*f* to sidewall 105*g*. Sidewall 105*i* extends from sidewall 105*b* to sidewall 105*e* and from sidewall 105*f* to sidewall 105*g*.

In some embodiments, the relationships between the lengths and widths of sidewalls 105 results in a base 101 that is substantially trapezoidal-shaped in a cross-section through the mid-point of the length of base 101. In some embodiments, the relationships between the lengths and widths of sidewalls 105 are such that sidewalls 105*f*, 105*g*, 105*h* and 105*i* that are trapezoidal-shaped. In some embodiments, one or more of the quantity of sidewalls, the relationships between the lengths and widths of sidewalls 105, or the relationships between the lengths and widths of the outer surface(s) of sidewall(s) 105 are such that the base 101 has a cross-section through the mid-point of the length of base 101 that is semi-circular, semi-elliptical, rectangular, square, or some other suitable shape.

Base 101 includes tubes 107*a*-107*n* (collectively referred to as "tubes 107") that extend from one or more inner surfaces of sidewall(s) 105 toward the open end of the cavity 201 within base 101. Sidewall 105*e* includes through-holes 109*a*-109*n* (collectively referred to as "through-hole 109"). Through-holes 109 are communicatively coupled with corresponding tubes 107. In some embodiments, one or more of through-holes 109 or tubes 107 are configured to accommodate a rod, spike, or other suitable fastener configured to constrain movement of the base 101 with respect to a surface over which the base 101 is positioned.

In some embodiments, base 101 is free from having through-holes 109 and sidewall 105*e* is continuous over tubes 107. In some embodiments, base 101 has alignment marks on the outer surface of sidewall 105*e* that indicate a position of tube 107 on the inner surface of sidewall 105*e*. In some embodiments, the alignment marks are one or more of printed, etched, stamped, cut, or indicated in some other suitable manner on the outer surface of sidewall 105*e*. In some embodiments, the one or more of the through-holes 109 is replaced by one or more slits in sidewall 105*e*.

In some embodiments, the quantity of through-holes 109 is equal to the quantity of tubes 107 included in base 101. In some embodiments, the quantity of through holes 109 is different from the quantity of tubes 107 included in base 101. Base 101 includes four tubes 107 and four through-holes 109. In some embodiments, base 101 includes at least one tube 107. In some embodiments, base 101 includes at least one through-hole 109 and is free from including a tube 107 in alignment with the at least one through-hole 109. In some embodiments, base 101 includes at least one through-hole 109 or at least one tube 107 at a sidewall 105*c* side of base 101 and at least one through-hole 109 or at least one tube 107 at a sidewall 105*d* side of base 101.

In some embodiments, having at least one through-hole 109 or at least one tube 107 at a sidewall 105*c* side of base 101 and at least one through-hole 109 or at least one tube 107 at a sidewall 105*d* side of base 101 makes it possible to restrict rotational movement of base 101 about the y-axis. In some embodiments, one or more other sidewalls 105 or surfaces of the sidewalls 105 has a tube 107, a through-hole 109, or an alignment mark configured to accommodate a rod, spike, or other suitable fastener, or through which a rod, spike, or other suitable fastener is capable of passing.

Sidewalls 105*a*, 105*b*, 105*c* and 105*d* have a corresponding edge 111 that defines the cavity 201 within base 101. In some embodiments, the edge 111 of at least one sidewall 105 is substantially planar. In some embodiments, one or more of the edges 111 of the sidewalls 105 has at least one recess 113*a*-113*n* (collectively referred to as recess 113 that extends from a bottom surface of edge 111 in the y-direction toward a top of the base 101 such that a portion of the edge 111 is offset from the bottom surface of edge 111.

A portion of sidewalls 105*a*, 105*b*, 105*c* and 105*d* is between recesses 113 and an adjacent sidewall such as sidewall 105*f*, 105*g*, 105*h* or 105*i*. In some embodiments, one or more of recesses 113 extends from the edge 111 through more than one sidewall 105. Recesses 113 are substantially rectangular. In some embodiments, one or more recesses 113 is square-shaped, U-shaped, V-shaped, or some other suitable shape.

In some embodiments, at least one recess 113 has another recess 113 on an opposite sidewall 105 of base 101. For example, if sidewall 105*a* includes recess 113*a*, sidewall 105*b* has a recess 113 that substantially aligns with recess 113*a* in the z-direction. In some embodiments, a quantity recesses 113 in one of sidewalls 105*a* or 105*b* is equal to a quantity of recesses 113 in the other of sidewalls 105*a* or 105*b*.

In some embodiments, a length of each recess 113 is equal to a length of each recess 113 on an opposite side of base 101. In some embodiments, the quantity of recesses 113 on one side of base 101 is different from the quantity of recesses 113 on the opposite side of base 101. In some embodiments, if the quantity of recesses 113 on one side of base 101 is different from the quantity of recesses 113 on the opposite side of base 101, a total length of the one or more recesses 113 on one side of base 101 is equal to a total length of the one or more recesses 113 on the other side of base 101.

In some embodiments, if base 101 is on a surface, the one or more recesses 113 are configured to facilitate fluid flow through the base 101 to prevent a build-up of fluid on one side of base 101. In some embodiments, the recesses 113 are positioned to divert fluid flow. For example, in some embodiments, if sidewall 105*b* includes one or more recesses 113, 115*a* is free from including recesses 113, and at least one of sidewall 115*c* or 115*d* includes one or more recesses 113, body 101 is configured to facilitate reception of a fluid by way of the recesses 113 in sidewall 105*b* and disbursement of a received fluid by way of the recesses 113 in sidewall 105*c* and/or sidewall 105*d*, diverting fluid flow away from a sidewall 105*a*-side of base 101. In some embodiments, wheel stop 100 includes one or more doors, panels, or otherwise moveable structures that are configured to be selectively moved to open or close a recess 113.

In some embodiments, sidewalls 105 comprise an injection molded rubber material. In some embodiments, sidewalls 105 comprise a compression molded rubber material. In some embodiments, sidewalls 105 comprise an injection molded recycled rubber material. In some embodiments, sidewalls 105 comprise a compression molded recycled rubber material. In some embodiments, sidewalls 105 comprise an injection molded recycled rubber and recycled plastic material. In some embodiments, sidewalls 105 comprise a compression molded recycled rubber and recycled plastic material. In some embodiments, sidewalls 105 comprise a polymer. In some embodiments, sidewalls 105 comprise a recycled polymer. In some embodiments, sidewalls 105 comprise a mesh rubber or a mesh recycled rubber. In some embodiments, sidewalls 105 comprise a mesh rubber or a mesh recycled rubber having a particle size in a range of 20 mesh to 100 mesh. In some embodiments, sidewalls 105 comprise a mesh rubber or a mesh recycled rubber having a particle size of 30 mesh to 90 mesh. In some embodiments, sidewalls 105 comprise a mesh rubber or a mesh recycled rubber having some other suitable particle size. In some embodiments, sidewalls 105 comprise a thermoplastic olefin (TPO), an olefinic thermoplastic elastomer, a polymer/filler blend comprising a thermoplastic, an elastomer or rubber, or some other suitable material. In some embodiments, one or more of the sidewalls 105 comprises a metal material. In some embodiments sidewalls 105 comprise one or more of an extruded rubber, recycled rubber, mesh rubber, mesh recycled rubber, polymer, recycled polymer, plastic, recycled plastic, thermoplastic olefin, elastomer, polymer/filler blend, some other suitable material, or a combination thereof. In some embodiments, sidewalls 105 comprise one or more of the aforementioned materials, a binder, a polyurethane, a masticated rubber, a combination of a virgin material and a recycled material, some other suitable material or combination of materials. In some embodiments, sidewalls 105 are integrally formed. In some embodiments, sidewalls 105 are separately formed and joined with one another by a weld, a rivet, an adhesive, a coupling, or some other suitable joint or other suitable fastener.

Plaques 103 are removably attached to one or more of the sidewalls 105. In some embodiments, plaques 103 comprise a same material as the sidewalls 105 base 101. In some embodiments, plaques 103 comprise a different material compared to the sidewalls 105 of base 101. In some embodiments, plaques 103 comprise an injection molded rubber material. In some embodiments, plaques 103 comprise a compression molded rubber material. In some embodiments, plaques 103 comprise an injection molded recycled rubber material. In some embodiments, plaques 103 comprise a compression molded recycled rubber material. In some embodiments, plaques 103 comprise an injection molded recycled rubber and recycled plastic material. In some embodiments, plaques 103 comprise a compression molded recycled rubber and recycled plastic material. In some embodiments, plaques 103 comprise a polymer. In some embodiments, plaques 103 comprise a recycled polymer. In some embodiments, plaques 103 comprise a metal material. In some embodiments, plaques 103 comprise a reflective material. In some embodiments, plaques 103 comprise a mesh rubber or a mesh recycled rubber. In some embodiments, plaques 103 comprise a mesh rubber or a mesh recycle rubber having a particle size in a range of 20 mesh to 100 mesh. In some embodiments, plaques 103 comprise a mesh rubber or a mesh recycled rubber having a particle size of 30 mesh to 90 mesh. In some embodiments, plaques 103 comprise a mesh rubber or a mesh recycled rubber having some other suitable particle size. In some embodiments, plaques 103 comprise a thermoplastic olefin (TPO), an olefinic thermoplastic elastomer, a polymer/filler blend comprising a thermoplastic, an elastomer or rubber, or some other suitable material. In some embodiments plaques 103 comprise one or more of an extruded rubber, recycled rubber, mesh rubber, mesh recycled rubber, polymer, recycled polymer, plastic, recycled plastic, thermoplastic olefin, elastomer, polymer/filler blend, some other suitable material, or a combination thereof. In some embodiments, plaques 107 comprise one or more of the aforementioned materials, a binder, a polyurethane, a masticated rubber, a combination of a virgin material and a recycled material, some other suitable material or combination of materials. In some embodiments, each of the base 101 and the plaques 103 comprises a polymer. In some embodiments, the base 101 comprises a first polymer and the plaque 103 comprises a second polymer different from the first polymer. In some embodiments, one or more of the plaques 103 comprises a material other than a recycled rubber material included in the sidewalls 105 of the base 101.

In some embodiments, plaques 103 are capable of being printed upon, stamped, etched, dyed, hot stamped, pad printed, infused or otherwise marked with a color, text, a logo, image, or other suitable content. In some embodiments, one or more of plaques 103 is printed upon, or colored by, an ink or a dye such that at least a portion of the plaque 103 is one or more of white, yellow, red, green, blue, some other suitable color, or a customized color. In some embodiments, one or more of plaques 103 has at least a portion that is printed-upon or colored white, yellow, red, green, blue, some other suitable color, or a customized color by way of at least one of an ink-jet printing process, a gel ink printing process, a laser-printing process, a combination of inks or dyes by way of a multi-color ink printing process, an offset printing process, a 3-D printing process, hot stamp printing, pad printing process, laser marking, laser printing, or other suitable manner by which a color, text, a logo, image, or other suitable content is capable of being printed upon, stamped, etched, dyed, infused or otherwise marked on a substrate. In some embodiments, one or more sidewalls 105 of base 101 are colored or dyed to be black, purple, blue, red, magenta, cyan, orange, yellow, or some other suitable color and one or more of the plaques 103 has at least a portion that is a different color than the color of the sidewalls 105 of base 101.

Plaques 103 are configured to be attached to base 101 by way of a coupling between a plaque 103 and base 101. In some embodiments, if a plaque 103 is damaged, marred, lost, missing, worn, or otherwise rendered unrecognizable or unusable, base 101 is capable of being coupled with a new plaque 103. In some embodiments, if wheel stop 100 has one or more plaques 103 attached thereto and the text, logo, image, content, reflective capability or color of one or more plaques 103 is to be changed, then one or more of the plaques 103 is capable of being removed and replaced by one or more new plaques 103 without having to replace the entire wheel stop. For example, if one or more of the plaques 103 is used as an advertisement or to designate a parking space number or other designation marker, and the advertisement is to be changed or the wheel stop is move to a different locating having a different parking space number or other designation marker, the plaques 103 make it possible to change out the advertisement or parking space number without having to replace the entire wheel stop.

Plaques 103*a*-103*d* are parallelograms. Plaque 103*n* is a trapezoid. In some embodiments, one or more of plaques 103 is some other suitable shape. In some embodiments, one or more plaques 103 are circular, triangular, square, rectangular, rhombic, pentagonal, hexagonal, octagonal, or some other suitable shape. In some embodiments, plaques 103 include different sets of plaques. For example, if one set of plaques has a first shape, another set of plaques has a second shape that different from or a mirror-image of the first shape. In some embodiments, plaques 103 of one set of plaques are configured to be positioned on a first side of the base 101, and plaques of the other set of plaques 103 are on a second side of the base 101 opposite the first side. In some embodiments, one or more of plaques 103 is substantially equal to a length of the surface of the sidewall to which the plaque 103 is attached.

In some embodiments, one or more of plaques 103 are removably attached to base 101 by way of a coupling, link, snap-on, press-fit, protrusion, screw, nail, staple, adhesive, magnet, rivet, or some other suitable fastener. In some embodiments, one or more of the sidewalls 105 of is configured to be flexed to receive a plaque 103 and then release to constrain the plaque 103 in position on the sidewall 105. In some embodiments, if the plaque breaks, is damaged, marred, worn, or is desired to be changed or replaced, the plaque 103 is configured to be detached, snapped-off, broken-away, or separated by some other suitable process and readily replaced by a different plaque 103.

Figure 2:
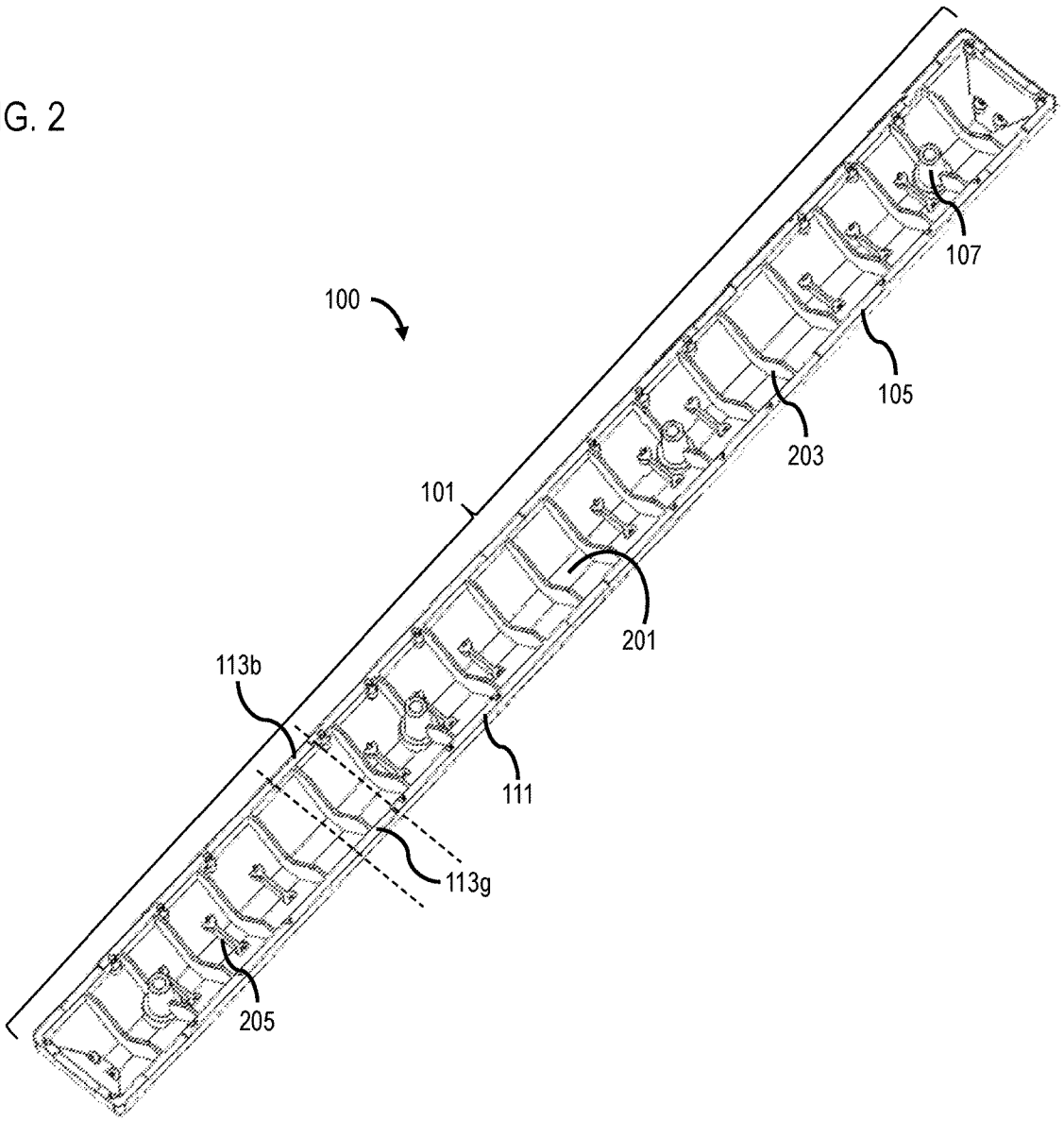
FIG. 2 is a bottom-side perspective view of a wheel stop, in accordance with one or more embodiments.

FIG. 2 is a bottom-side perspective view of a wheel stop 100, in accordance with one or more embodiments. One or more edges 111 of one or more sidewalls 105 define cavity 201 within base 101. Base 101 has a plurality of ribs 203 extending from the inner surface of sidewalls 105 toward the open end of the cavity 201. Ribs 203 are separated from one another along the length of base 101. In some embodiments, ribs 203 are equally spaced along the length of the base 101. In some embodiments, the spacing between ribs 203 is based on a proximity of the ribs 203 to a tube 107 or a through-hole 109 (FIG. 1). In some embodiments, the distance between neighboring ribs 203 is reduced if the neighboring ribs 203 are within a predetermined distance to a tube 107 or a through-hole 109 than if the neighboring ribs 203 are farther than the predetermined distance from a tube 107 or a through-hole 109.

Ribs 203 are V-shaped. In some embodiments, one or more ribs 203 are trapezoidal-shaped, substantially-shaped to match the shape of the cross-section of base 101, or some other suitable shape. In some embodiments, one or more of the ribs 203 is in contact with an inner surface of multiple sidewalls 105. In some embodiments, ribs 203 are in contact with the inner surfaces of sidewall 105*a* (FIG. 1), sidewall 105*b* (FIG. 1), sidewall 105*e* (FIG. 1), 105*h* (FIG. 1) and 105*i* (FIG. 1).

In some embodiments, ribs 203 comprise an injection molded rubber material. In some embodiments, ribs 203 comprise a compression molded rubber material. In some embodiments, ribs 203 comprise an injection molded recycled rubber material. In some embodiments, ribs 203 comprise a compression molded recycled rubber material. In some embodiments, ribs 203 comprise an injection molded recycled rubber and recycled plastic material. In some embodiments, ribs 203 comprise a compression molded recycled rubber and recycled plastic material. In some embodiments, ribs 203 comprise a polymer. In some embodiments, ribs 203 comprise a recycled polymer. In some embodiments, ribs 203 comprise a mesh rubber or a mesh recycled rubber. In some embodiments, ribs 203 comprise a mesh rubber or a mesh recycle rubber having a particle size in a range of 20 mesh to 100 mesh. In some embodiments, ribs 203 comprise a mesh rubber or a mesh recycled rubber having a particle size of 30 mesh to 90 mesh. In some embodiments, sidewalls comprise a mesh rubber or a mesh recycled rubber having some other suitable particle size. In some embodiments, ribs 203 comprise a thermoplastic olefin (TPO), an olefinic thermoplastic elastomer, a polymer/filler blend comprising a thermoplastic, an elastomer or rubber, or some other suitable material. In some embodiments ribs 203 comprise one or more of an extruded rubber, recycled rubber, mesh rubber, mesh recycled rubber, polymer, recycled polymer, plastic, recycled plastic, thermoplastic olefin, elastomer, polymer/filler blend, some other suitable material, or a combination thereof. In some embodiments, ribs 203 comprise one or more of the aforementioned materials, a binder, a polyurethane, a masticated rubber, a combination of a virgin material and a recycled material, some other suitable material or combination of materials.

In some embodiments, ribs 203 are integrally formed with one or more sidewalls 105. In some embodiments, ribs 203 are separately formed from one or more sidewalls 105 and joined with one or more sidewalls 105 by a weld, rivet, an adhesive, a coupling, or some other suitable joint. In some embodiments, ribs 203 comprise a metal material. In some embodiments, each of the sidewalls 105 and the ribs 203 comprises a polymer. In some embodiments, the sidewalls 105 comprise a first polymer and the ribs 203 comprise a second polymer different from the first polymer. In some embodiments, one or more of the ribs 203 comprises a material other than a recycled rubber material included in the sidewalls 105.

In some embodiments, the geometry of the one or more sidewalls 105 and the ribs 203 are such that the cavity 201 renders the base 101 substantially hollow. The ribs 203 are configured to provide rigidity to the base 101 while facilitating a reduction in overall weight of the base 101. In some embodiments, the one or more sidewalls 105 have a uniform thickness in a direction that is normal to at least one of the outer surface of a sidewall 105 or the corresponding inner surface of the sidewall 105. In some embodiments, the one or more sidewalls 105 have a variable thickness in a direction that is normal to at least one of the outer surface of a sidewall 105 or the corresponding inner surface of the sidewall 105. In some embodiments, a variable thickness helps to reduce an overall weight of the base 101.

Tubes 107 extend from the inner surface of one or more of the sidewalls 105 of base 101 toward the open end of the cavity 201. In some embodiments, at least one tube 107 is in contact with at least one rib 203. In some embodiments, an end of at least one tube 107 opposite to the inner surface from which the at least one tube 107 extends is substantially co-planar with the edge 111 of at least one sidewall 105. In some embodiments, an end of at least one tube 107 opposite to the inner surface from which the at least one tube 107 extends is within the cavity 201 such that the sidewalls 105 are configured to support the at least one tube 107 above a planar surface over which the base 101 is positioned. In some embodiments, one or more tubes 107 are configured to accommodate and support a fastener that is within the tube 107 to constrain the base 101 with respect to the surface to which the base 101 is fastened. In some embodiments, one or more tubes 107 are configured to facilitate dispersion of an adhesive into the cavity 201 to attach the base 101 to a surface. For example, if a tube 107 has an end that is within the cavity 201, the tube 107 is configured to reduce interference the surface over which the base 101 is positioned may cause with respect to the flow of adhesive into the cavity 201.

In some embodiments, tubes 107 comprise an injection molded rubber material. In some embodiments, tubes 107 comprise a compression molded rubber material. In some embodiments, tubes 107 comprise an injection molded recycled rubber material. In some embodiments, tubes 107 comprise an injection molded recycled rubber and recycled polymer material. In some embodiments, tubes 107 comprise a compression molded recycled rubber and recycled plastic material. In some embodiments, tubes 107 comprise a compression molded recycled rubber material. In some embodiments, tubes 107 comprise a polymer. In some embodiments, tubes 107 comprise a recycled polymer. In some embodiments, tubes 107 comprise a mesh rubber or a mesh recycled rubber. In some embodiments, tubes 107 comprise a mesh rubber or a mesh recycle rubber having a particle size in a range of 20 mesh to 100 mesh. In some embodiments, tubes 107 comprise a mesh rubber or a mesh recycled rubber having a particle size of 30 mesh to 90 mesh. In some embodiments, tubes 107 comprise a mesh rubber or a mesh recycled rubber having some other suitable particle size. In some embodiments, tubes 107 comprise a thermoplastic olefin (TPO), an olefinic thermoplastic elastomer, a polymer/filler blend comprising a thermoplastic, an elastomer or rubber, or some other suitable material. In some embodiments tubes 107 comprise one or more of an extruded rubber, recycled rubber, mesh rubber, mesh recycled rubber, polymer, recycled polymer, plastic, recycled plastic, thermoplastic olefin, elastomer, polymer/filler blend, some other suitable material, or a combination thereof. In some embodiments, tubes 107 comprise one or more of the aforementioned materials, a binder, a polyurethane, a masticated rubber, a combination of a virgin material and a recycled material, some other suitable material or combination of materials.

In some embodiments, tubes 107 are integrally formed with one or more sidewalls 105. In some embodiments, tubes 107 are separately formed from one or more sidewalls 105 and joined with one or more sidewalls 105 by a weld, an adhesive, a coupling, or some other suitable joint. In some embodiments, tubes 107 comprise a metal material. In some embodiments, each of the sidewalls 105 and the tubes 107 comprises a polymer. In some embodiments, the sidewalls 105 comprise a first polymer and the tubes 107 comprise a second polymer different from the first polymer. In some embodiments, one or more of the tubes 107 comprises a material other than a recycled rubber material included in the sidewalls 105.

In some embodiments, base 101 includes support structures 205 that extend from the inner surface of one or more of the sidewalls 105 of base 101 toward the open end of the cavity 201. The support structures 205 are configured to mate with a portion of a plaque 103 (FIG. 1) to removably attach the plaque 103 to the base 101. In some embodiments, support structures 205 have a through-hole in communication with a plaque seat 301 (FIG. 3) through which at least a portion of plaque 103 is capable of being inserted. In some embodiments, the portion of the plaque 103 that is inserted into the support structure 205 extends beyond an edge of support structure 205 into cavity 201. In some embodiments, the portion of plaque 103 that extends beyond an edge of support structure 205 into cavity 201 is configured to engage support structure 205 such that the portion of plaque 103 is in a fastened position with respect to base 101. In some embodiments, a portion of plaque 103 is configured to be press-fit into support structure 205 such that the portion of plaque 103 is in a fastened position with respect to base 101. In some embodiments, the portion of plaque 103 that extends beyond an edge of support structure 205 into cavity 201 is configured to be coupled with a nut, bolt, pin or other suitable fastener to removably attach plaque 103 to base 101.

In some embodiments, support structures 205 comprise an injection molded rubber material. In some embodiments, support structures 205 comprise a compression molded rubber material. In some embodiments, support structures 205 comprise an injection molded recycled rubber material. In some embodiments, support structures 205 comprise a compression molded recycled rubber material. In some embodiments, support structures 205 comprise an injection molded recycled rubber and recycled plastic material. In some embodiments, support structures 205 comprise a compression molded recycled rubber and recycled plastic material. In some embodiments, support structures 205 comprise a polymer. In some embodiments, support structures 205 comprise a recycled polymer. In some embodiments, support structures 205 comprise a mesh rubber or a mesh recycled rubber. In some embodiments, support structures 205 comprise a mesh rubber or a mesh recycle rubber having a particle size in a range of 20 mesh to 100 mesh. In some embodiments, support structures 205 comprise a mesh rubber or a mesh recycled rubber having a particle size of 30 mesh to 90 mesh. In some embodiments, support structures 205 comprise a mesh rubber or a mesh recycled rubber having some other suitable particle size. In some embodiments, support structures 205 comprise a thermoplastic olefin (TPO), an olefinic thermoplastic elastomer, a polymer/filler blend comprising a thermoplastic, an elastomer or rubber, or some other suitable material. In some embodiments support structures 205 comprise one or more of an extruded rubber, recycled rubber, mesh rubber, mesh recycled rubber, polymer, recycled polymer, plastic, recycled plastic, thermoplastic olefin, elastomer, polymer/filler blend, some other suitable material, or a combination thereof. In some embodiments, support structures 205 comprise one or more of the aforementioned materials, a binder, a polyurethane, a masticated rubber, a combination of a virgin material and a recycled material, some other suitable material or combination of materials.

In some embodiments, support structures 205 are integrally formed with one or more sidewalls 105. In some embodiments, support structures 205 are separately formed from one or more sidewalls 105 and joined with one or more sidewalls 105 by a weld, an adhesive, a coupling, or some other suitable joint. In some embodiments, support structures 205 comprise a metal material. In some embodiments, each of the sidewalls 105 and the support structures 205 comprises a polymer. In some embodiments, the sidewalls 105 comprise a first polymer and the support structures 205 comprise a second polymer different from the first polymer. In some embodiments, one or more of the support structures 205 comprises a material other than a recycled rubber material included in the sidewalls 105.

As discussed with respect to FIG. 1, in some embodiments, base 101 includes one or more recess 113 on one side of the base 101 that are substantially aligned with another recess on an opposite side of the base 101. For example, recess 113*b* is substantially aligned with recess 113*g* in the depth direction of base 101.

Figure 3:
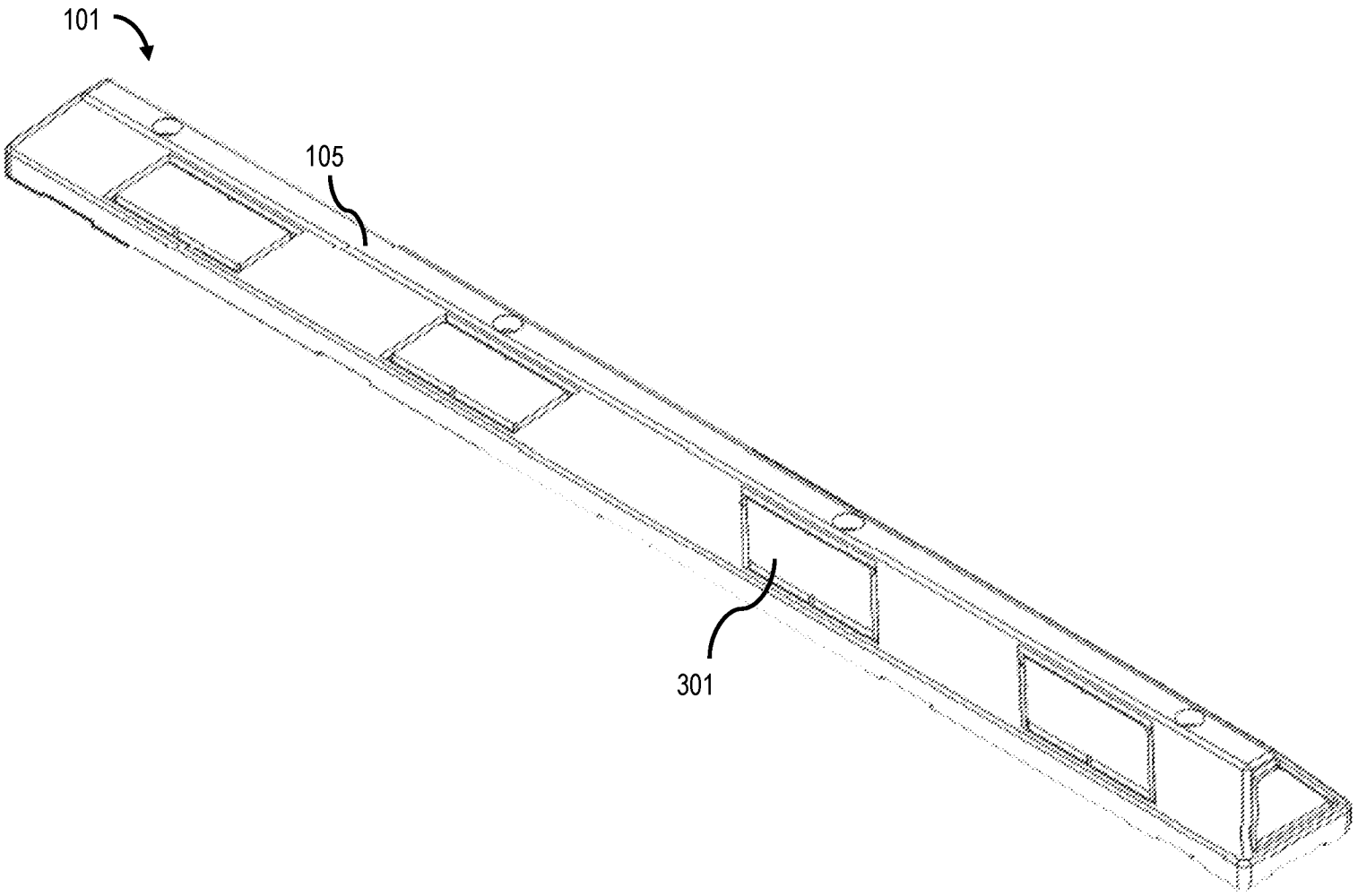
FIG. 3 is a left-side perspective view of base, in accordance with one or more embodiments.

FIG. 3 is a left-side perspective view of base 101 without plaques 103 (FIG. 1), in accordance with one or more embodiments. One or more sidewalls 105 of base 101 include at least one plaque seat 301. In some embodiments, plaque seat 301 is a recessed region on an outer surface of at least one of the sidewalls 105 that is configured to accommodate a plaque 103. In some embodiments, the plaque seats 301 are substantially the same shape as a plaque 103 that is to be removably attached to base 101. In some embodiments, plaque seats 301 have through-holes that are in communication with a corresponding support structure 205 (FIG. 2). In some embodiments, one or more plaque seats 301 have a depth with respect to the outer surface of the sidewall 105 of base 101 such that the plaque 103 that is removably attached to the base 101 has a surface that is substantially co-planar with the outer surface of the sidewall 105 of base 101. In some embodiments, one or more plaque seats 301 have a depth with respect to the outer surface of the sidewall 105 of base 101 such that the plaque 103 that is removably attached to the base 101 has a surface that is offset from the outer surface of the sidewall 105 of base 101. In some embodiments, if the plaque 103 is offset from the outer surface of sidewall 105 of the base, the plaque 103 protrudes outwardly and away from the outer surface of sidewall 105. In some embodiments, if the plaque 103 is offset from the outer surface of sidewall 105 of the base, the plaque 103 is recessed inwardly from the outer surface of sidewall 105.

Figure 4:
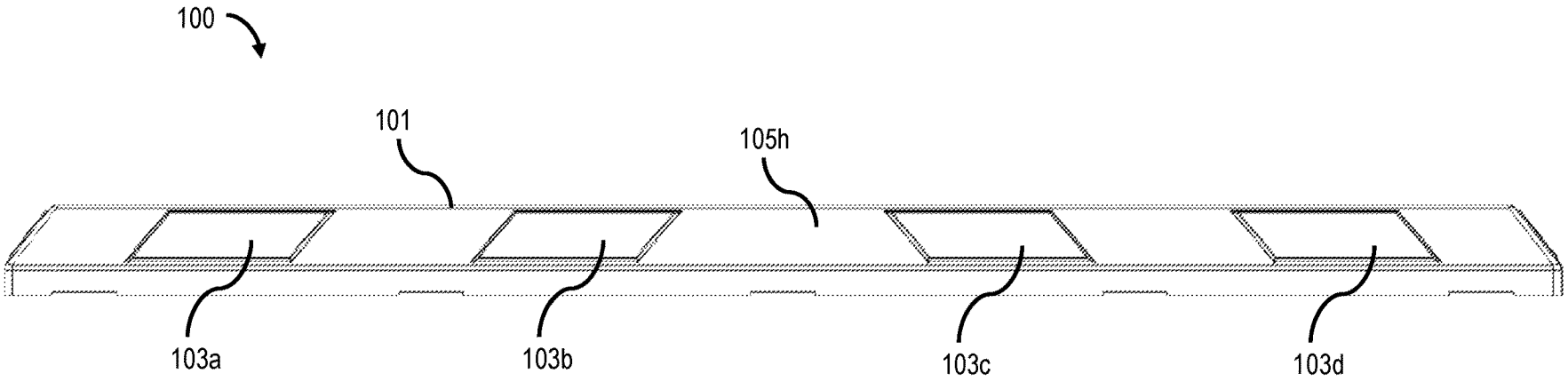
FIG. 4 is a front-side view of a wheel stop, in accordance with one or more embodiments.

FIG. 4 is a front side view of wheel stop 100, in accordance with one or more embodiments. Plaques 103*a* and 103*b* are parallelogram-shaped having a first orientation included in a first set of plaques 103 and plaques 103*c* and 103*d* are parallelogram-shaped having a second orientation included in a second set of plaques 103. The second orientation is a mirror-image of the first orientation. The first set of plaques 103 and the second set of plaques 103 are on sidewall 105*h* of base 101. Sidewall 105*h* is trapezoidal-shaped.

Figure 5:
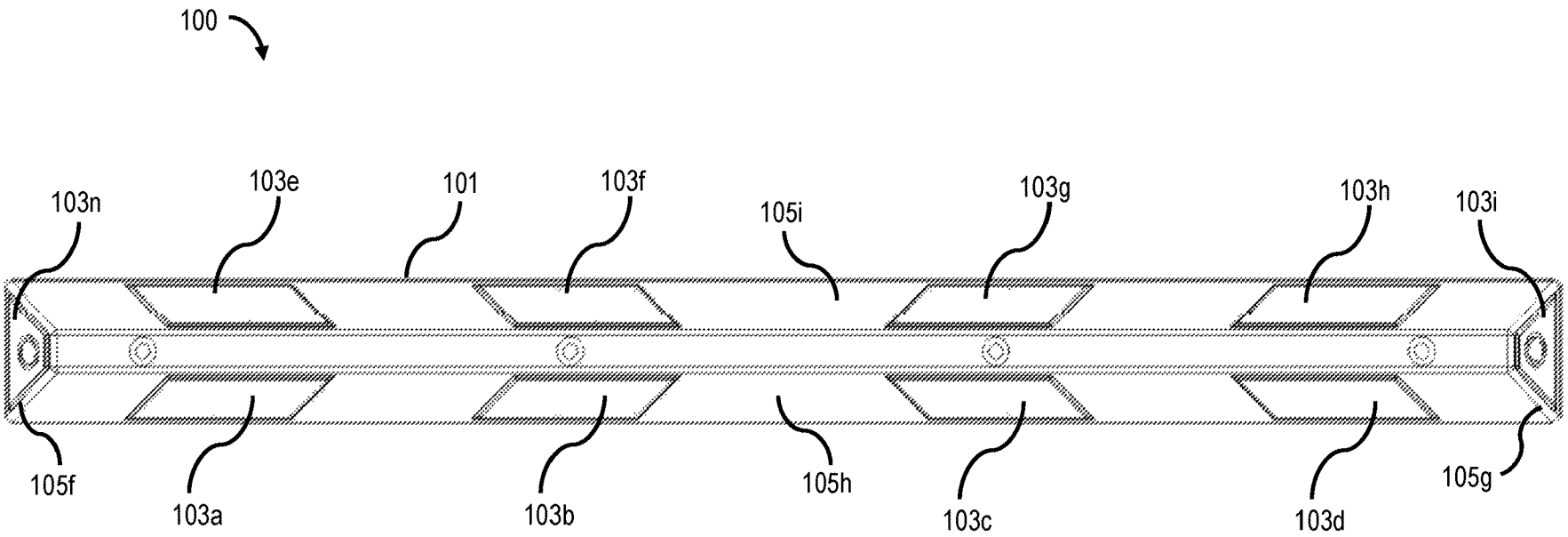
FIG. 5 is a top-side view of a wheel stop, in accordance with one or more embodiments.

FIG. 5 is a top side view of wheel stop 100, in accordance with one or more embodiments. Plaques 103*a*, 103*b*, 103*g* and 103*h* are parallelogram-shaped having a first orientation included in a first set of plaques 103 and plaques 103*c*, 103*d*, 103*e* and 103*f* are parallelogram-shaped having a second orientation included in a second set of plaques 103. The second orientation is a mirror-image of the first orientation. Plaques 103*a*, 103*b*, 103*c* and 103*d* are on sidewall 105*h* of base 101. Sidewall 105*h* is trapezoidal-shaped. Plaques 103*e*, 103*f*, 103*g* and 103*h* are on sidewall 105*i* of base 101. Sidewall 105*i* is trapezoidal-shaped. Plaques 103*n* and 103*i* are trapezoidal-shaped and included in a third set of plaques. Plaque 103*n* is on sidewall 105*f* of base 101 and plaque 103 is on sidewall 105*g* of base 101. Sidewalls 105*f* and 105*g* are trapezoidal-shaped.

Figure 6:
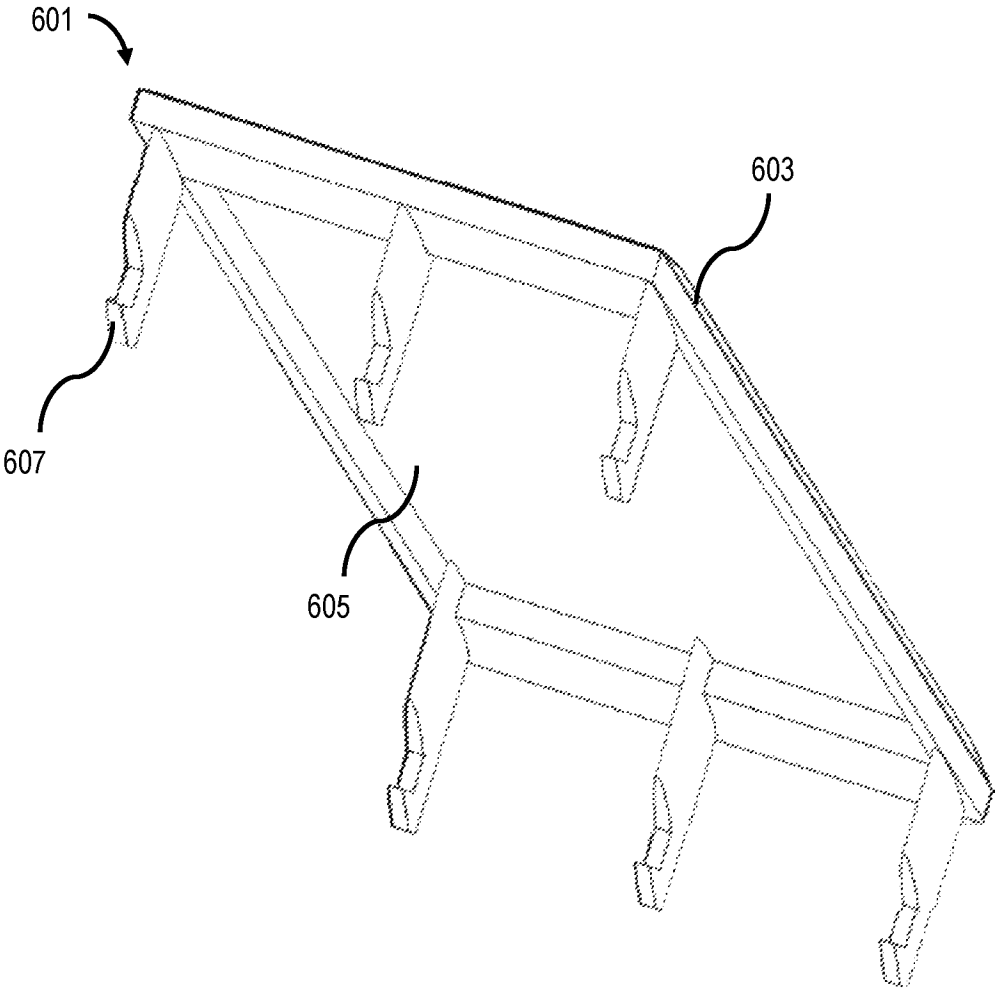
FIG. 6 is a bottom-side perspective view of a plaque, in accordance with some embodiments.
Figure 7A:
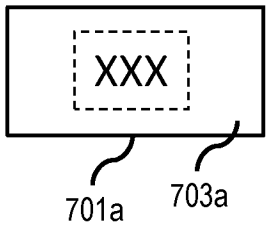
FIG. 7A is a top-side view of a rectangular plaque, in accordance with one or more embodiments.
Figure 7B:
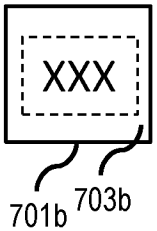
FIG. 7B is a top-side view of a square plaque, in accordance with one or more embodiments.
Figure 7C:
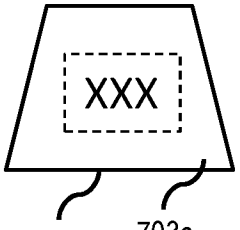
FIG. 7C is a top-side view of a trapezoidal plaque, in accordance with one or more embodiments.
Figure 7D:
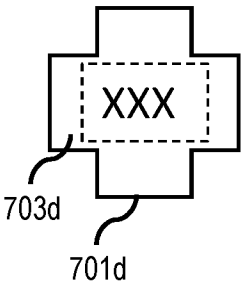
FIG. 7D is a top-side view of a cross-shaped plaque, in accordance with one or more embodiments.
Figure 7E:
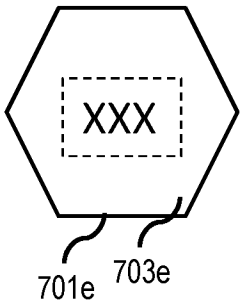
FIG. 7E is a top-side view of a hexagonal plaque, in accordance with one or more embodiments.
Figure 7F:
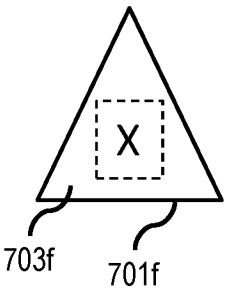
FIG. 7F is a top-side view of a triangular plaque, in accordance with one or more embodiments.

FIG. 6 is a bottom-side perspective view of a plaque 601, in accordance with some embodiments. Plaque 601 is usable as plaque 103 (FIG. 1). Plaque 601 comprises an outer surface 603, and inner surface 605 and a plurality of protrusions 607 on an inner surface-side of plaque 601.

Plaque 601, like plaques 103, is configured to be removably attached to base 101 (FIG. 1). Protrusions 607 are configured to engage with a portion of base 101 if the plaque 601 is positioned, for example, in plaque seat 301 (FIG. 3). Plaque 601 includes six protrusions. In some embodiments, plaque 601, or plaque 103, includes some other suitable quantity of protrusions capable of coupling the plaque with base 101. The protrusions 607 are configured to be inserted into the through-holes in plaque seat 301 and to be received by a support structure 205 (FIG. 2) on the inner side of base 101. In some embodiments, the protrusion 607 has a geometry that locks the protrusion 607 in a fastened position with support structure 205. In some embodiments, the protrusion 607 comprises a hooked end configured to engage at least one of the support structures 205. In some embodiments, one or more support structures 205 is configured to flex upon insertion of a protrusion 607 such that the protrusion 607 is able to pass through the support structure 205 and the hooked end is caused to engage an edge of the support structure 205 once the hooked end of the protrusion 607 is through the support structure 205 and the support structure 205 returns to a pre-flexed form that substantially corresponds to a shape of the support structure 205 prior to insertion of the protrusion 607. In some embodiments, the protrusion 607 is press-fit into the plaque seat 301 and into the support structure 205 such that the plaque 601 is removably attached to base 101. In some embodiments, the protrusion 607 is configured to be accommodated by support structure 205 and plaque 601 is locked in fastened position with respect to base 101 by a nut, a bolt, or some other suitable coupling configured to mate with a geometry of protrusion 607.

FIGS. 7A through 7F are top-side views of plaques 701*a*-701*f* (collectively referred to as "plaque 701"), in accordance with one or more embodiments. Each plaque 701 has a corresponding outer surface 703*a*-703*f* (collectively referred to as "outer surface 703") that is configured to face away from base 101 (FIG. 1) if the plaque 701 is removably attached to the base 101. Plaques 701 are examples of the different shapes that the plaques 103 is capable of being. In some embodiments, a plaque 701 or a plaque 103, is some other suitable shape. In some embodiments, the outer surface 703 of a plaque 701 is substantially planar. In some embodiments, the outer surface 703 of a plaque 701 is rounded, pyramidal, ridged, or has some other suitable topography. In some embodiments, a text, logo, color, image, or other content "X" printed, stamped or applied to outer surface 703 of plaque 701.

Figure 8:
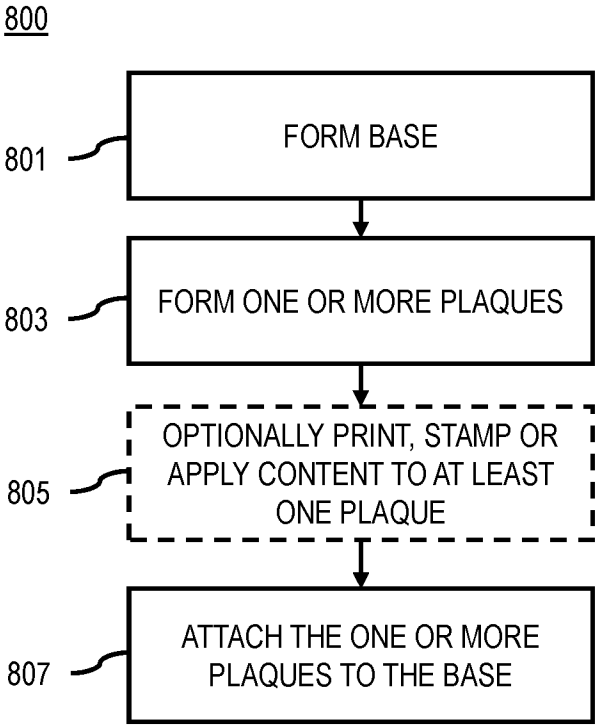
FIG. 8 is a flowchart of a method of forming a wheel stop, in accordance with one or more embodiments.

FIG. 8 is a flowchart of a method 800 of forming a wheel stop such as wheel stop 100 (FIG. 1), in accordance with one or more embodiments.

In step 801, wheel stop base such as base 101 (FIG. 1) is formed by way of an injection molding process, a compression molding process, a 3D printing process, an extrusion molding process, or some other suitable process. The wheel stop base is formed having one or more sidewalls comprising one or more of a polymer, a rubber, a recycled polymer, a recycled rubber, a mesh rubber, a mesh recycled rubber, a thermoplastic olefin, or some other suitable material or combination of materials. In some embodiments, the wheel stop base is formed to also include one or more ribs, tubes, support structures, through-holes and/or plaque seats. In some embodiments, the wheel stop base is formed having at least one sidewall having an outer surface, an inner surface, and an edge defining a cavity within the base. In some embodiments, one or more of the sidewalls, one or more ribs, tubes, or support structures are integrally formed by way of the injection molding process, the compression molding process, the 3D printing process, or some other process. In some embodiments, one or more of the plaque seats or the through-holes are formed during the injection molding process, the compression molding process, the 3D printing process, or other suitable process.

In some embodiments, one or more of the optional ribs, tubes, support structures, through-holes and/or plaque seats is formed after the at least one sidewall is formed by way of a separate injection molding process, compression molding process, 3D printing process, or other suitable process. For example, in some embodiments, the at least one sidewall is formed and then material is removed from the at least one sidewall to form the plaque seats and/or the through-holes. In some embodiments, material is removed by cutting, etching, drilling, or some other suitable process.

In some embodiments, a material included in the one or more sidewalls is dyed such that the base has at least one portion that is white, yellow, red, green, blue, some other suitable color, or a customized color.

In step 803, one or more plaques such as plaque 103 (FIG. 1) are formed by way of an injection molding process, a compression molding process, a 3D printing process, or some other suitable process. In some embodiments, a material included in the plaque is dyed such that the plaque has at least one portion that is white, yellow, red, green, blue, some other suitable color, or a customized color.

In optional step 805, an image, text, icon, logo or other suitable content is printed, etched, stamped, hot stamped, pad-printed, laser marked, laser printed, dyed, applied or otherwise marked by some other suitable process to at least one of the one or more plaques.

In step 807, the one or more plaques are attached to the base.

An aspect of this description is related to an apparatus comprising a base having a length in a first direction, a height in a second direction different from the first direction, and a depth in a third direction different from the first direction and the second direction. The base comprises at least one sidewall having an outer surface, an inner surface, and an edge defining an open end of a cavity within the base. The base also comprises a plurality of ribs extending from the inner surface of the at least one sidewall toward the open end of the cavity. The ribs of the plurality of ribs are separated from one another along the first direction. The base further comprises at least one tube extending from the inner surface of the at least one sidewall toward the open end of the cavity. The apparatus also comprises at least one plaque removably attached to the outer surface of base.

Another aspect of this description is related to an apparatus comprising a base comprising a plurality of sidewalls. The plurality of sidewalls include a first sidewall, a second sidewall, a third sidewall, a fourth sidewall, a fifth sidewall, a sixth sidewall, a seventh sidewall, an eighth sidewall and a ninth sidewall. The first sidewall has a first length in a first direction and a first width in a second direction different from the first direction. The second sidewall has a second length in the first direction and a second width in the second direction. The second sidewall is separated from the first sidewall by a first distance in a third direction substantially perpendicular to the first direction. The third sidewall extends from a first end of the first sidewall to a first end of the second sidewall. The third sidewall has a third length in the third direction and a third width in the second direction. The fourth sidewall extends from a second end of the first sidewall opposite to the first end of the first sidewall to a second end of the second sidewall opposite to the first end of the second sidewall. The fourth sidewall has a fourth length in the third direction and a fourth width in the second direction. The fifth sidewall has a fifth length in the first direction and a fifth width in the third direction. The fifth sidewall is separated from the first sidewall, the second sidewall, the third sidewall and the fourth sidewall by a third distance in the second direction. The sixth sidewall extends from the third sidewall to a first end of the fifth sidewall. The seventh sidewall extends from the fourth sidewall to a second end of the fifth sidewall opposite to the first end of the fifth sidewall. The eighth sidewall extends from the first sidewall to the fifth sidewall and from the sixth sidewall to the seventh sidewall. The ninth sidewall extends from the second sidewall to the fifth sidewall and from the sixth sidewall to the seventh sidewall. The apparatus also comprises a plurality of plaques removably attached to one or more of the sixth sidewall, the seventh sidewall, the eighth sidewall or the ninth sidewall. The sidewalls of the plurality of sidewalls comprise an injection-molded recycled rubber material.

A further aspect of this description is related to an apparatus comprising a base having a length in a first direction, a height in a second direction different from the first direction, and a depth in a third direction different from the first direction and the second direction. The base comprises at least one sidewall having an outer surface, an inner surface, and an edge defining an open end of a cavity within the base. The at least one sidewall has a substantially trapezoidal-shaped cross-section. The base also comprises a plurality of ribs extending from the inner surface of the at least one sidewall toward the open end of the cavity. The ribs of the plurality of ribs are separated from one another along the first direction. The base further comprises at least one tube extending from the inner surface of the at least one sidewall toward the open end of the cavity. The apparatus also comprises a plurality of plaques removably attached to the base. The at least one sidewall, the ribs of the plurality of ribs and the at least one tube comprise an injection-molded recycled rubber material. The plaques of the plurality of plaques comprise one or more of a same recycled rubber material included in the at least one sidewall or a material other than the recycled rubber material included in the at least one sidewall.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An apparatus, comprising:

a base having a length in a first direction, a height in a second direction different from the first direction, and a depth in a third direction different from the first direction and the second direction, the base comprising:

at least one sidewall having an outer surface, an inner surface, and an edge defining an open end of a cavity within the base;

at least one tube extending from the inner surface of the at least one sidewall toward the open end of the cavity; and a support structure extending from the inner surface of the base toward the open end of the cavity; and at least one plaque removably attached to the outer surface of the base, wherein the at least one plaque comprises a protrusion, press-fit into the base, and extending from a surface of the at least one plaque through the at least one sidewall and into the cavity within the base to removably attach the at least one plaque to the base, and the at least one plaque is removably attached to the outer surface of the base by way of a mating between the support structure and the protrusion.

2. The apparatus of claim 1, wherein the base comprises a first material and the plaque comprises a second material different from the first material.

3. The apparatus of claim 1, wherein each of the base and the plaque comprises a polymer.

4. The apparatus of claim 3, wherein the base comprises a first polymer and the plaque comprises a second polymer different from the first polymer.

5. The apparatus of claim 1, wherein that at least one sidewall has a variable thickness between the outer surface and the inner surface in a direction that is normal to at least one of the outer surface or the inner surface.

6. The apparatus of claim 1, wherein the outer surface is one of a plurality of outer surfaces, and the at least one sidewall comprises:

a first outer surface having a first length in the first direction and a first width in the second direction;

a second outer surface having a second length in the first direction and a second width in the second direction, the second outer surface being separated from the first outer surface by a first distance in the third direction;

a third outer surface extending from a first end of the first outer surface to a first end of the second outer surface, the third outer surface having a third length in the third direction and a third width in the second direction;

a fourth outer surface extending from a second end of the first outer surface opposite to the first end of the first outer surface to a second end of the second outer surface opposite to the first end of the second outer surface, the fourth outer surface having a fourth length in the third direction and a fourth width in the second direction;

a fifth outer surface having a fifth length in the first direction and a fifth width in the third direction, the fifth outer surface being separated from the first outer surface, the second outer surface, the third outer surface and the fourth outer surface by a third distance in the second direction;

a sixth outer surface extending from the third outer surface to a first end of the fifth outer surface;

a seventh outer surface extending from the fourth outer surface to a second end of the fifth outer surface opposite to the first end of the fifth outer surface;

an eighth outer surface extending from the first outer surface to the fifth outer surface and from the sixth outer surface to the seventh outer surface; and a ninth outer surface extending from the second outer surface to the fifth outer surface and from the sixth outer surface to the seventh outer surface.

7. The apparatus of claim 6, wherein the fifth length is less than the first length and the second length, and the fifth width is less than the third length and the fourth length.

8. The apparatus of claim 7, wherein one or more of the sixth outer surface, the seventh outer surface, the eighth outer surface or the ninth outer surface is trapezoidal.

9. The apparatus of claim 6, wherein the base further comprises a plurality of ribs extending from the inner surface of the at least one sidewall toward the open end of the cavity, and at least one rib of the plurality of ribs is v-shaped.

10. The apparatus of claim 6, wherein the base further comprises a plurality of ribs extending from the inner surface of the at least one sidewall toward the open end of the cavity, and each of the first outer surface, second outer surface, third outer surface, fourth outer surface, fifth outer surface, sixth outer surface, seventh outer surface, eighth outer surface and ninth outer surface has a corresponding inner surface, and at least one rib of the plurality of ribs is in contact with at least five of the inner surfaces.

11. The apparatus of claim 1, wherein the at least one sidewall has a through-hole communicatively coupled with the at least one tube.

12. The apparatus of claim 1, wherein the edge is substantially planar.

13. The apparatus of claim 1, wherein the edge has at least one first recess on a first side of the at least one sidewall and at least one second recess on a second side of the at least one sidewall opposite to the first side, and the at least one first recess is substantially aligned with the at least one second recess in the first direction or the second direction.

14. The apparatus of claim 1, wherein the at least one plaque is one of a plurality of plaques removably attached to the outer surface of the base, and each plaque of the plurality of plaques comprises a printed material.

15. The apparatus of claim 14, wherein the plurality of plaques comprises a first set of plaques and a second set of plaques, the first set of plaques have a first shape, the second set of plaques have a second shape that is a mirror-image of the first shape, the plaques of the first set of plaques are on a first side of the base, and the plaques of the second set of plaques are on a second side of the base opposite the first side.

16. The apparatus of claim 1, wherein the protrusion has a first end on a plaque-side of the protrusion and a second end opposite the first end, the second end of the protrusion comprises a hook, and the hook is configured to fix the protrusion to the base.

17. The apparatus of claim 1, wherein the at least one plaque is removable from a fixed position with the base by breaking the protrusion after the protrusion is fixed to the base.

18. An apparatus, comprising:

a base comprising a plurality of sidewalls, the plurality of sidewalls comprising:

a first sidewall having a first length in a first direction and a first width in a second direction different from the first direction;

a second sidewall having a second length in the first direction and a second width in the second direction, the second sidewall being separated from the first sidewall by a first distance in a third direction substantially perpendicular to the first direction;

a third sidewall extending from a first end of the first sidewall to a first end of the second sidewall, the third sidewall having a third length in the third direction and a third width in the second direction;

a fourth sidewall extending from a second end of the first sidewall opposite to the first end of the first sidewall to a second end of the second sidewall opposite to the first end of the second sidewall, the fourth sidewall having a fourth length in the third direction and a fourth width in the second direction;

a fifth sidewall having a fifth length in the first direction and a fifth width in the third direction, the fifth sidewall being separated from the first sidewall, the second sidewall, the third sidewall and the fourth sidewall by a third distance in the second direction;

a sixth sidewall extending from the third sidewall to a first end of the fifth sidewall;

a seventh sidewall extending from the fourth sidewall to a second end of the fifth sidewall opposite to the first end of the fifth sidewall;

an eighth sidewall extending from the first sidewall to the fifth sidewall and from the sixth sidewall to the seventh sidewall;

a ninth sidewall extending from the second sidewall to the fifth sidewall and from the sixth sidewall to the seventh sidewall; and a support structure extending from the inner surface of the base; and a plurality of plaques removably attached to one or more of the sixth sidewall, the seventh sidewall, the eighth sidewall or the ninth sidewall, wherein at least one plaque of the plurality of plaques comprises a protrusion, press-fit into the base, and extending from a surface of the at least one plaque through the at least one sidewall to removably attach the at least one plaque to the base, the at least one plaque is removably attached to the base by way of a mating between the support structure and the protrusion, and the sidewalls of the plurality of sidewalls comprise an injection-molded recycled rubber material.

19. The apparatus of claim 18, wherein the plaques of the plurality of plaques comprise a material other than the recycled rubber material included in the sidewalls of the base.

20. An apparatus, comprising:

a base having a length in a first direction, a height in a second direction different from the first direction, and a depth in a third direction different from the first direction and the second direction, the base comprising:

at least one sidewall having an outer surface, an inner surface, and an edge defining an open end of a cavity within the base, the at least one sidewall having a substantially trapezoidal-shaped cross-section;

a plurality of ribs extending from the inner surface of the at least one sidewall toward the open end of the cavity;

at least one tube extending from the inner surface of the at least one sidewall toward the open end of the cavity; and a support structure extending from the inner surface of the base toward the open end of the cavity; and a plurality of plaques removably attached to the base, wherein at least one plaque of the plurality of plaques comprises a protrusion, press-fit into the base, and extending from a surface of the at least one plaque through the at least one sidewall and into the cavity within the base, the at least one plaque is removably attached to the base by way of a mating between the support structure and the protrusion, the at least one sidewall, the ribs of the plurality of ribs and the at least one tube comprise an injection-molded recycled rubber material, and the plaques of the plurality of plaques comprise one or more of a same recycled rubber material included in the at least one sidewall or a material other than the recycled rubber material included in the at least one sidewall.

* * * * *